US011414255B2

(12) United States Patent
Todaka

(10) Patent No.: US 11,414,255 B2
(45) Date of Patent: Aug. 16, 2022

(54) BAG BODY AND METHOD FOR MANUFACTURING BAG BODY

(71) Applicant: IDEMITSU UNITECH CO., LTD., Tokyo (JP)

(72) Inventor: Takumi Todaka, Chiba (JP)

(73) Assignee: IDEMITSU UNITECH CO., LTD., Tokyo (JP)

( * ) Notice: Subject to any disclaimer, the term of this patent is extended or adjusted under 35 U.S.C. 154(b) by 0 days.

(21) Appl. No.: 17/055,439

(22) PCT Filed: May 13, 2019

(86) PCT No.: PCT/JP2019/018889
§ 371 (c)(1),
(2) Date: Nov. 13, 2020

(87) PCT Pub. No.: WO2019/221049
PCT Pub. Date: Nov. 21, 2019

(65) Prior Publication Data

US 2021/0139224 A1 May 13, 2021

(30) Foreign Application Priority Data

May 16, 2018 (JP) ..... JP2018-094567
Sep. 27, 2018 (JP) ..... JP2018-181787

(51) Int. Cl.
*B65D 81/34* (2006.01)
*B65D 33/01* (2006.01)
*B65D 33/25* (2006.01)

(52) U.S. Cl.
CPC ..... *B65D 81/3438* (2013.01); *B65D 33/01* (2013.01); *B65D 33/25* (2013.01); *B65D 81/3407* (2013.01); *B65D 2205/02* (2013.01)

(58) Field of Classification Search
CPC .... B65D 81/3438; B65D 33/01; B65D 33/25; B65D 81/3407; B65D 2205/02
(Continued)

(56) References Cited

U.S. PATENT DOCUMENTS 10,906,701 B2 * 2/2021 Todaka ..... B65D 33/2541
2019/0016507 A1 1/2019 Todaka
2021/0107703 A1 4/2021 Todaka

FOREIGN PATENT DOCUMENTS

CN 108471847 A 8/2018
EP 2119561 A1 * 11/2009 ..... B32B 5/14
(Continued)

OTHER PUBLICATIONS

Machine translation of JP-10114376-A.*
(Continued)

*Primary Examiner* — Jes F Pascua
(74) *Attorney, Agent, or Firm* — Millen, White, Zelano & Branigan, PC; Ryan Pool

(57) ABSTRACT

A bag includes: a bag body at least having a first surface and a second surface facing each other with a storing space formed between the first surface and the second surface; and a tape member provided between the first surface and the second surface and defining one side of the storing space. The tape member includes, in a cross section, a first portion formed of a first resin composition and a second portion formed of a second resin composition different from the first resin composition. The first portion is bonded to both the first surface and the second surface at a first section of a longitudinal direction of the tape member while bonded to only the second surface at a second section of the longitudinal direction, and the second portion is bonded to the first surface at the second section.

21 Claims, 8 Drawing Sheets

(58) Field of Classification Search
USPC ..... 383/203
See application file for complete search history.

(56) References Cited

FOREIGN PATENT DOCUMENTS

| | | | | | |
|---|---|---|---|---|---|
| EP | 3400825 | A1 | | 11/2018 | |
| JP | 10114376 | A | * | 5/1998 | ..... B65D 81/3461 |
| JP | 2005225544 | A | | 8/2005 | |
| JP | 4450639 | B2 | * | 4/2010 | |
| JP | 2011173628 | A | | 9/2011 | |
| JP | 2013-501688 | A | | 1/2013 | |
| JP | 2013-46644 | A | | 3/2013 | |
| JP | 2014012552 | A | * | 1/2014 | |
| JP | 2017-128391 | A | | 7/2017 | |
| JP | 2021024602 | A | * | 2/2021 | |
| WO | 2017/119449 | A1 | | 7/2017 | |

OTHER PUBLICATIONS

Machine translation of JP-2014012552-A.*
Machine translation of WO 2017/119449 A1.*
Machine translation of JP-4450639-B2.*
International Search Report dated Aug. 13, 2019 issued in corresponding PCT/JP2019/018889 application (2 pages).
Office Action issued in corresponding Chinese patent application No. 201980032093.7 dated Jan. 30, 2022 (English pp. 1-15).
Office Action issued in corresponding Japanese patent application No. 2018-181787 dated Mar. 15, 2022 (pp. 1-3) and english translation thereof (pp. 1-6).

* cited by examiner

BAG BODY AND METHOD FOR MANUFACTURING BAG BODY

TECHNICAL FIELD

The present invention relates to a bag and a manufacturing method of the bag.

BACKGROUND ART

A bag that can contain food or the like and be subjected to heat-cooking has been widely used. Regarding such a bag, Patent Literature 1 describes a configuration where a steam release mechanism configured to prevent breakage due to overexpansion during heat-cooking is provided. The bag described in Patent Literature 1 includes the steam release mechanism including a weak seal, a periphery of which is weakly sealed to a bag body to close a cut formed in a circle near a side seal of the bag body. In the steam release mechanism, the weak seal comes off with an increase in an inner pressure to a certain level due to steam generated during heat-cooking, so that the steam is discharged through the cut to prevent the bag body from being broken due to overexpansion.

CITATION LIST

Patent Literature(s)

Patent Literature 1: JP 2013-46644 A

SUMMARY OF THE INVENTION

Problem(s) to be Solved by the Invention

However, in a case where a steam release mechanism includes a weak seal as described in Patent Literature 1, an inner pressure at which the discharge of steam starts varies depending on a bonding strength of the weak seal. Further, if the bonding strength of the weak seal is uneven, only a part of the weak seal is likely to come off, resulting in a reduction in a discharge amount of the steam. Thus, according to the technology described in Patent Literature 1, machining conditions of the weak seal have an influence on the discharge of steam, so that it is not easy to form a steam ventilator configured to stably discharge steam.

Accordingly, regarding a bag including a steam ventilator that can be formed using a tape member, an object of the invention is to provide a new and improved bag allowing a steam ventilator configured to stably discharge steam to be easily formed and a manufacturing method of the bag.

Means for Solving the Problem(s)

According to an aspect of the invention, a bag includes: a bag body at least having a first surface and a second surface facing each other with a storing space formed between the first surface and the second surface; and a tape member provided between the first surface and the second surface and defining one side of the storing space, the tape member including, in a cross section, a first portion formed of a first resin composition and a second portion formed of a second resin composition different from the first resin composition, in which the first portion is bonded to both the first surface and the second surface at a first section of a longitudinal direction of the tape member while bonded to only the second surface at a second section of the longitudinal direction, and the second portion is bonded to the first surface at the second section.

In the above configuration, a bonding portion between the tape member and each of the first surface and the second surface of the bag body is located at a portion formed of a resin composition different between the first section and the second section. Thus, it is enabled to discharge steam only at the second section when, for instance, the tape member is subjected to an inner pressure of the storing space. A discharge amount of the steam is stabilized because the section where the steam is to be discharged is fixed. Further, the discharge amount of the steam does not considerably vary depending on machining conditions since it is not necessary to partially change a bonding strength between the bag body and the tape member. Therefore, the configuration allows easy formation of the steam ventilator configured to stably discharge steam.

According to another aspect of the invention, a manufacturing method of the above-described bag includes: a first step of bonding the first portion to the second surface at the first section and the second section; and a second step of bonding the first portion to the first surface at the first section while bonding the second portion to the first surface at the second section. The method may further include a step of filling contents into the storing space, the step being performed between the first step and the second step.

BRIEF DESCRIPTION OF DRAWING(S)

DESCRIPTION OF EMBODIMENT(S)

Figure 1:
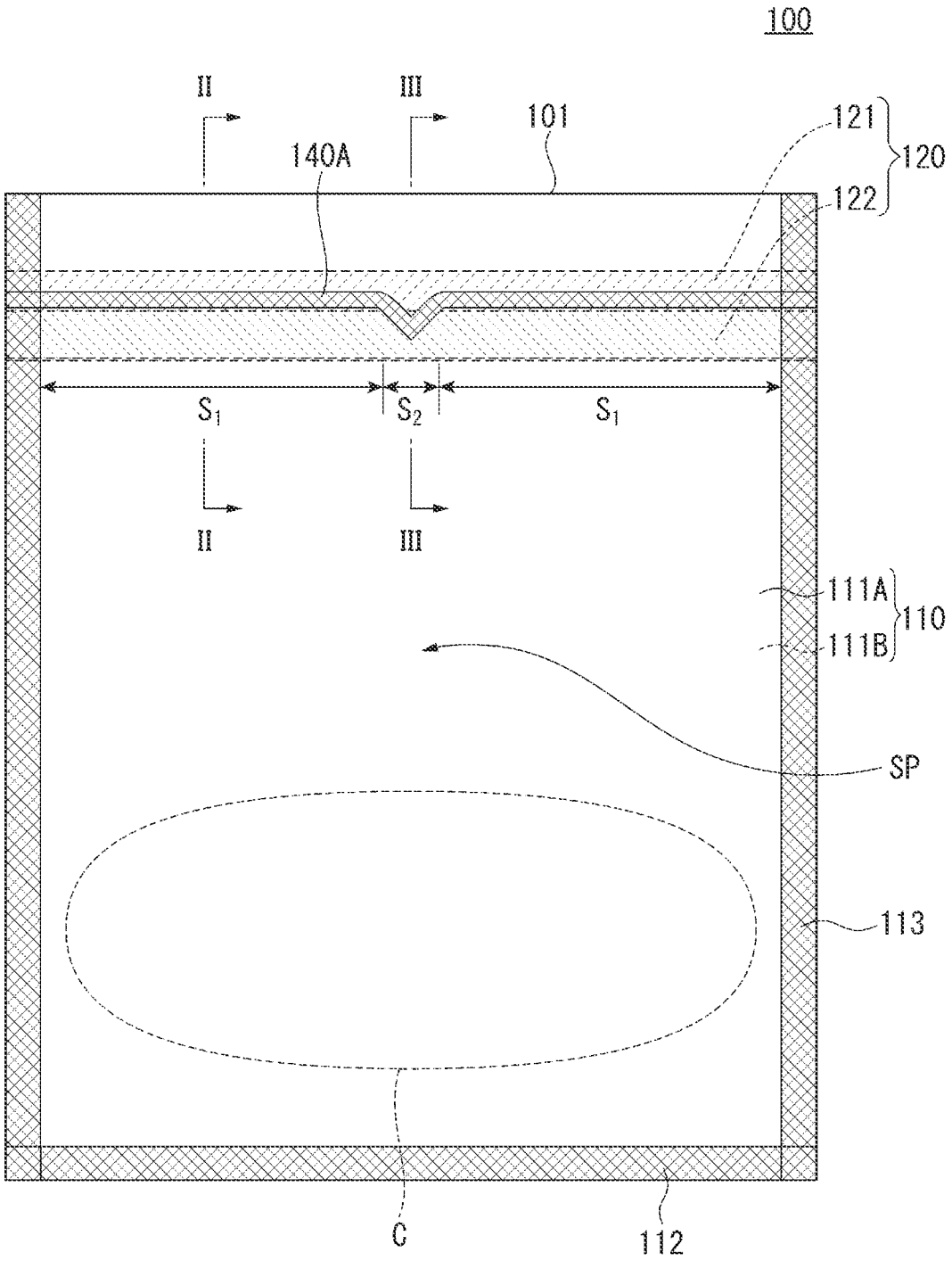
FIG. 1 is a plan view of a bag according to an exemplary embodiment of the invention.

A detailed description will be made below on preferred exemplary embodiments of the invention with reference to the attached drawings. It should be noted that the same reference signs are used herein and in the drawings to refer to components with substantially the same functional configurations to omit the redundant description thereof.

First Exemplary Embodiment

Configuration of Bag

Figure 2:
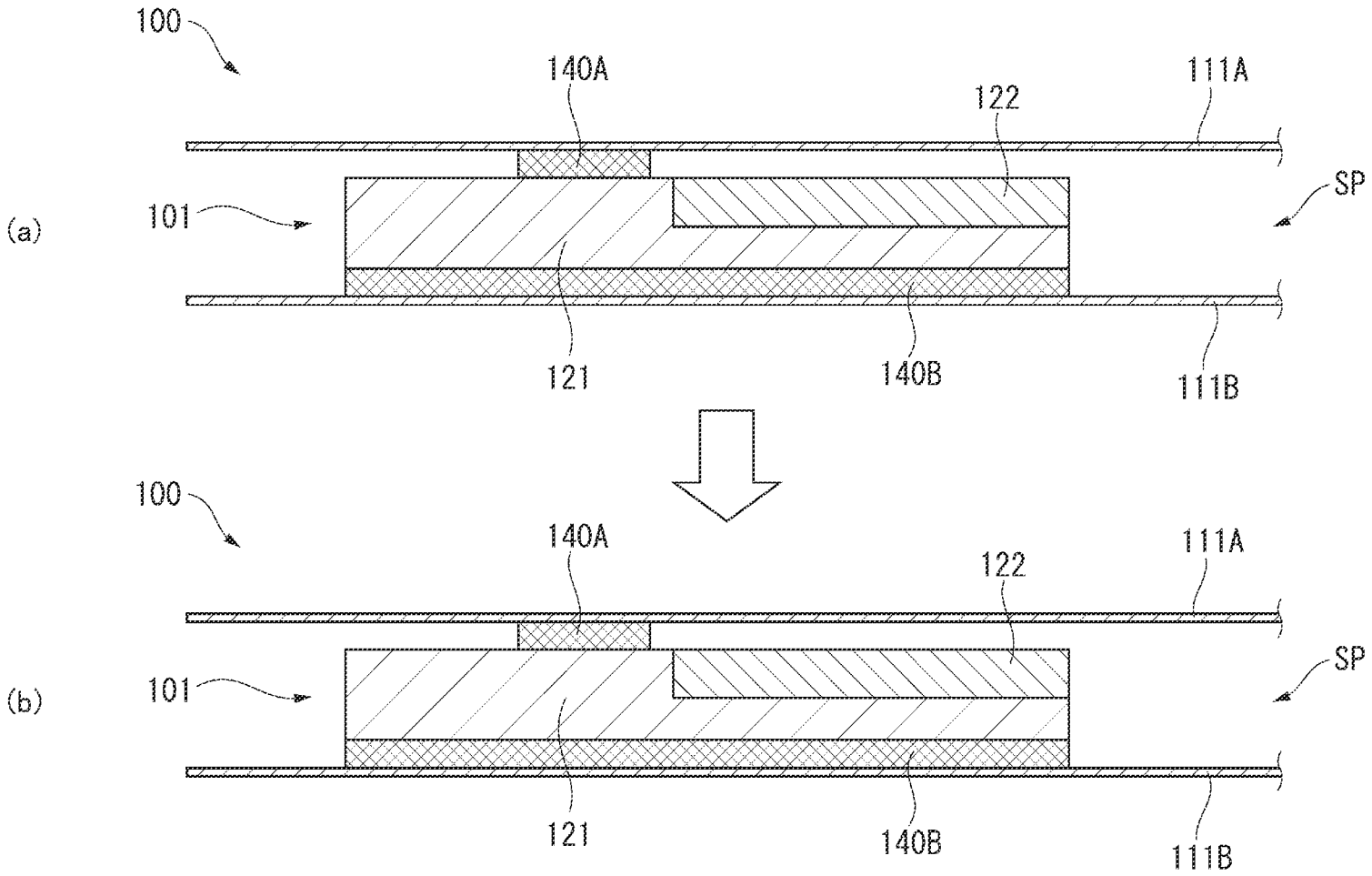
FIG. 2 is a cross-sectional view taken along a II-II line of the bag shown in FIG. 1.
Figure 3:
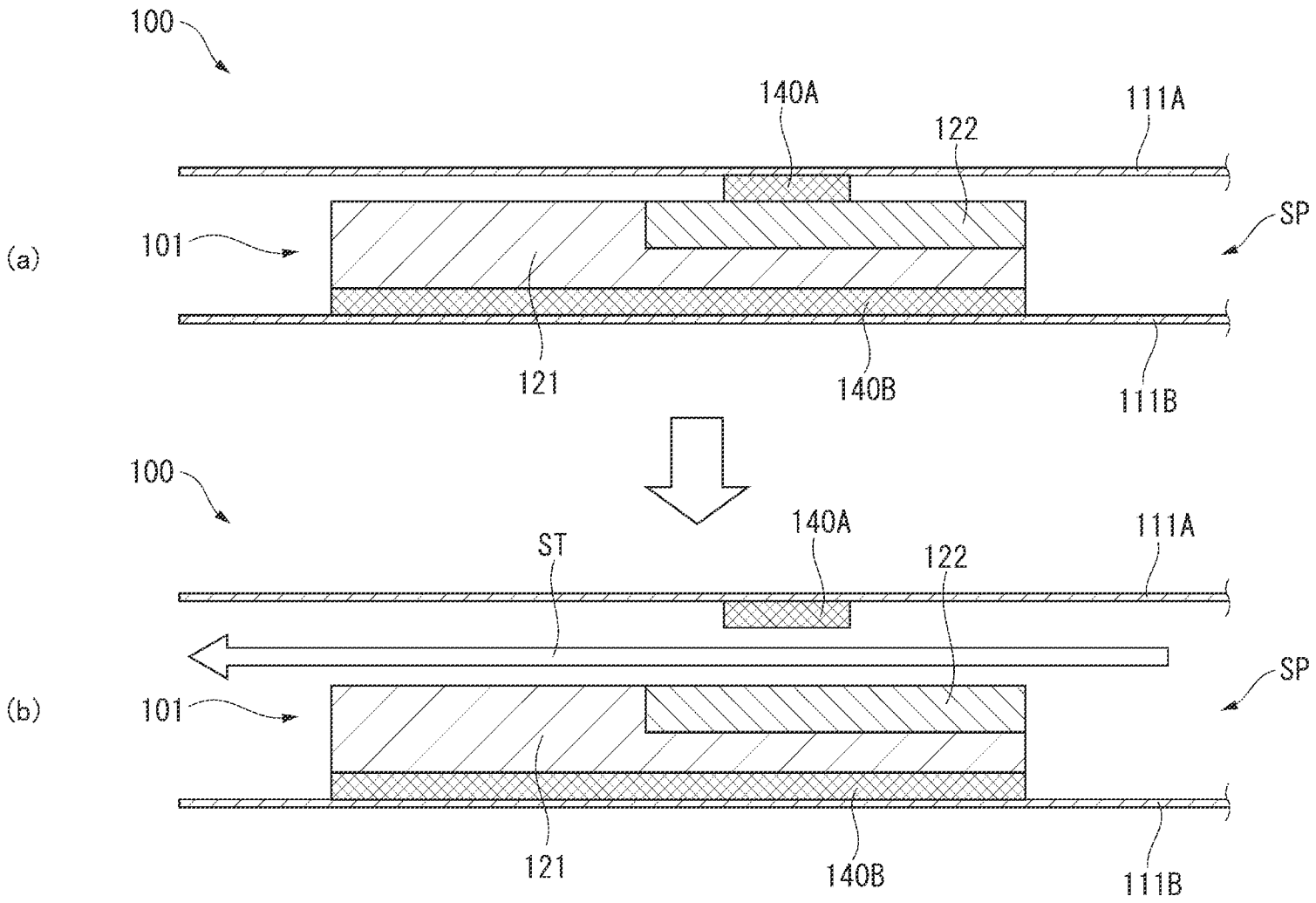
FIG. 3 is a cross-sectional view taken along a III-III line of the bag shown in FIG. 1.

FIG. 1 is a plan view of a bag according to a first exemplary embodiment of the invention. FIG. 2 and FIG. 3 are cross-sectional views taken along the II-II and III-III lines of the bag shown in FIG. 1, respectively. Description will be made below on a configuration of the bag according to this exemplary embodiment with reference to these figures.

As shown in the figures, a bag 100 includes: a film 110 in the form of a bag body having a first surface 111A and a second surface 111B facing each other; and a tape member 120 located between the first surface 111A and the second surface 111B of the film 110. The tape member 120 is bonded to the first surface 111A and the second surface 111B at least at a part relative to a width direction over the entire length thereof as described later, thus defining one side of a storing space SP formed between the first surface 111A and the second surface 111B of the film 110. As described later, a cross section of the tape member 120 includes a first portion 121 formed of a first resin composition and a second portion 122 formed of a second resin composition.

The film 110 is formed of, for instance, a single-layered or multi-layered thermoplastic resin. More specifically, the film 110 may be formed of low density polyethylene (LDPE), linear low density polyethylene (LLDPE), or polypropylene (PP). PP may be homopolypropylene (HPP), random polypropylene (RPP), or block polypropylene (BPP). In a case where the film 110 is multi-layered, biaxially oriented polypropylene (OPP), biaxially oriented polyethylene terephthalate (OPET), or biaxially oriented nylon (ONy) may be used as an outer base material thereof. Further, the film 110 may include a layer of an inorganic material.

It should be noted that although in this exemplary embodiment, the bag body having the first surface 111A and the second surface 111B is formed by bonding two sheets of the film 110 to each other at a bottom seal 112 and a side seal 113, in another embodiment, the first surface 111A and the second surface 111B may be formed by folding a single sheet of the film 110 at a portion corresponding to the side seal 113. Alternatively, a so-called gusset, or a portion where the film 110 is folded inside may be formed at a portion corresponding to the bottom seal 112 or the side seal 113 in the example of FIG. 1. In this case, the gusset may be formed by the film 110 or formed by another film bonded to the film 110. Further, the bag 100 may be a stand-up pouch that can be set upright by means of a gusset formed at a bottom thereof.

Further, although in this exemplary embodiment, an opening 101 of the bag 100 is provided by forming the bottom seal 112 and the side seal 113 but not forming a top seal, in another embodiment, a top seal may be formed in addition to the bottom seal 112 and the side seal 113 so that the opening 101 can be provided in the bag 100 afterward by cutting the portion between the top seal and the tape member 120. In still another exemplary embodiment, a bag without the bottom seal 112, that is, the bag with the storing space SP not sealed opposite the tape member 120, may be provided. In this case, the bottom seal 112 is formed after contents are filled into the storing space SP. In addition to the above, the invention is also applicable to bags with typical various configurations.

The tape member 120 is formed by, for instance, extrusion molding of a polyolefin resin. More specifically, the tape member 120 may be formed of low density polyethylene (LDPE), linear low density polyethylene (LLDPE), or polypropylene (PP). PP may be homopolypropylene (HPP), random polypropylene (RPP), or block polypropylene (BPP). A known additive such as a stabilizer, an antioxidant, a lubricant, an antistatic, or a colorant may be added as required to the material of the tape member 120.

As shown in FIG. 1, in the longitudinal direction, the tape member 120 is divided into a first section $S_1$ and a second section $S_2$. FIG. 2(*a*) shows a cross section at the first section $S_1$ and FIG. 3(*a*) shows a cross section at the second section $S_2$. As shown in FIG. 2(*a*) and FIG. 3(*a*), in this exemplary embodiment, the cross section of the tape member 120, which is the same at the first section $S_1$ and the second section $S_2$, includes the first portion 121 and the second portion 122. As described above, the first portion 121 is formed of the first resin composition, while the second portion 122 is formed of the second resin composition. The second resin composition is a resin composition different from the first resin composition. In this exemplary embodiment, for instance, a combination of resin compositions listed below as an example is employed to cause a bonding strength between the second portion 122 of the tape member 120 and the first surface 111A of the film 110 to be lower than a bonding strength between the first portion 121 and the first surface 111A.

Specifically, for the first resin composition and the second resin composition according to the first exemplary embodiment, combinations as shown in Table 1 below are possible. It should be noted that LD in the table stands for low density polyethylene (LDPE), LL stands for linear low density polyethylene (LLDPE), and Tm stands for a melting point of the resin composition. The melting point of the resin composition herein refers to a peak temperature of melting to be detected by differential scanning calorimetry (DSC); in a case where the resin composition is a blend, the melting point refers to a lower peak temperature. In a case where the melting point is defined as described above, in examples shown in Table 1 the melting point of the first resin composition is higher than the melting point of the second resin composition by 10 degrees C. or more. It should be noted that a sealant layer of the film 110 (first surface 111A) is formed of homopolypropylene (HPP), block polypropylene (BPP), or random polypropylene (RPP) in each example. In the examples shown in Table 1, the first resin composition has a higher compatibility than the second resin composition in terms of a relationship with a resin composition forming the sealant layer of the first surface 111A.

TABLE 1

Combination Examples of Resin Compositions

| First Resin Composition | Second Resin Composition |
|---|---|
| HPP (Tm: 160° C.) | LD/PP blend (Tm: 109° C./137° C.) |
| HPP (Tm: 160° C.) | LL/PP blend (Tm: 123° C./140° C.) |
| RPP (Tm: 134° C.) | m-LL (Tm: 95° C.) |

As shown in FIG. 2(*a*), at the first section $S_1$, the first portion 121 of the tape member 120 is bonded to both the first surface 111A and the second surface 111B of the film 110. Specifically, at the first section $S_1$, a bonding region 140A is formed between the first portion 121 of the tape member 120 and the first surface 111A, while a bonding region 140B is likewise formed between the first portion 121 and the second surface 111B. It should be noted that it is optional whether or not the second portion 122 is bonded to the first surface 111A at the first section $S_1$, since the first section $S_1$ is a section where steam ventilation is not enabled even during the heating of the contents as described later.

Meanwhile, as shown in FIG. 3(*a*), at the second section $S_2$, the first portion 121 of the tape member 120 is not bonded to the first surface 111A of the film 110 but bonded only to the second surface 111B. Specifically, at the second section $S_2$, the bonding region 140B is formed between the first portion 121 and the second surface 111B, while no bonding region is formed between the first portion 121 and the first surface 111A. Meanwhile, at the second section $S_2$, the second portion 122 of the tape member 120 is bonded to the first surface 111A of the film 110. Specifically, at the second section $S_2$, the bonding region 140A is formed between the second portion 122 and the first surface 111A.

Behavior During Steam Ventilation

Figure 4:
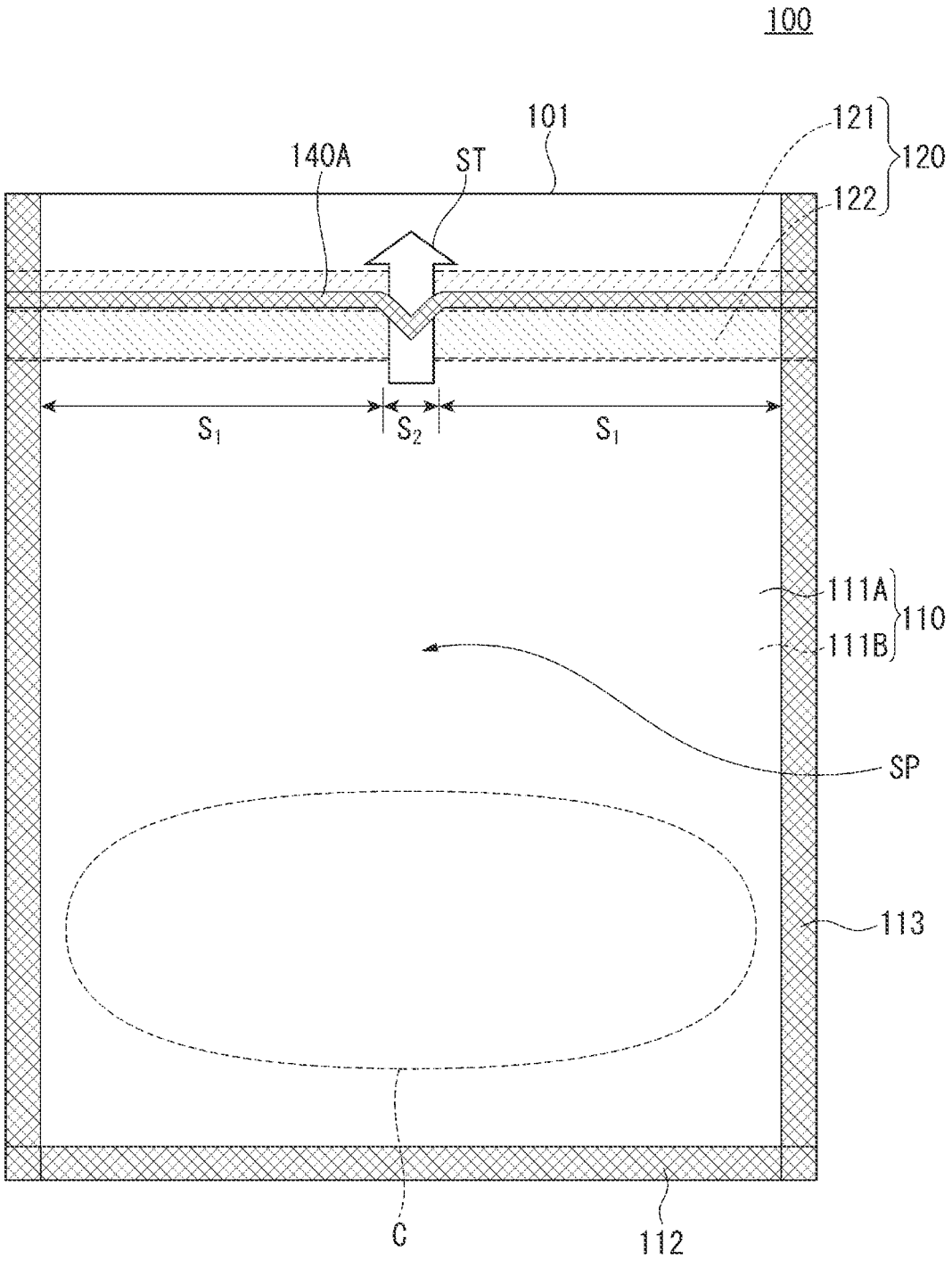
FIG. 4 is a diagram for showing a behavior of the bag for steam ventilation according to an exemplary embodiment of the invention.

FIG. 2(*b*) and FIG. 3(*b*) show behaviors of the tape member 120 at the first section $S_1$ and the second section $S_2$ during the heating of the contents. In a case where moisture-containing contents C, such as food, are stored in the storing space SP of the bag 100 and heated with a microwave, steam generated from the contents increases an inner pressure of the storing space SP. In this case, at the second section $S_2$, the bonding region 140A, which bonds the second portion 122 of the tape member 120 to the first surface 111A of the film 110 is peeled off at an interface of the second portion 122 as shown in FIG. 3(*b*). Thus, at the second section $S_2$, the storing space SP is brought into communication with an outer space through the gap between the first surface 111A of the film 110 and the second portion 122 of the tape member 120 during the heating of the contents, which enables the discharge of steam ST. A plan view of FIG. 4 also shows that the steam ST is discharged at the second section $S_2$ during the heating of the contents C.

Meanwhile, at the first section $S_1$, the bonding region 140A bonds the first portion 121 of the tape member 120 to the first surface 111A as shown in FIG. 2(*b*). In this regard, in this exemplary embodiment, the bonding strength between the second resin composition forming the second portion 122 and the film 110 is lower than the bonding strength between the first resin composition of the first portion 121 and the film 110 as described above. Thus, the interfacial peeling of the bonding region 140A occurs earlier at the second section $S_2$ than at the first section $S_1$. When the steam ST is discharged by the interfacial peeling at the second section $S_2$, the inner pressure of the storing space SP is kept from increasing. Consequently, no interfacial peeling occurs at the first section $S_1$ unlike at the second section $S_2$, so that the storing space SP is not brought into communication with the outer space at the first section $S_1$.

As described above, in this exemplary embodiment, the first portion 121 and the second portion 122 of the tape member 120 are formed respectively of the first resin composition and the second resin composition. A portion of the tape member 120 bonded to the first surface 111A and the second surface 111B via the bonding regions 140A and 140B are different between the first section $S_1$ and the second section $S_2$. Therefore, it is enabled to bring the storing space SP into communication with the outer space only at the second section $S_2$ to discharge the steam when the inner pressure of the storing space SP increases due to the generation of steam. A discharge amount of the steam is stabilized because the section where the steam is to be discharged is fixed. Further, the discharge amount of the steam does not considerably vary depending on machining conditions since it is not necessary to partially change the bonding strength of each of the bonding regions 140A and 140B.

In the first exemplary embodiment of the invention as described above, the second section $S_2$ of the tape member 120 functions as a steam ventilator, thereby enabling the stabilization of the discharge amount of steam during the heating of the contents C. That is, in this exemplary embodiment, the steam ventilator can be formed by changing a bonding state of the first portion 121 and the second portion 122 of the tape member 120 and the first surface 111A and the second surface 111B of the film 110 between the first section $S_1$ and the second section $S_2$, instead of changing the bonding strength between the film 110 and the tape member 120. The steam ventilator, which is opened at a certain temperature to discharge a stable amount of steam, can thus be easily formed.

In the above example, the first portion 121 is in an L-shape in the cross section of the tape member 120, while the second portion 122 is in a shape fitted in a recessed portion of the L-shape, so that the second portion 122 and the second surface 111B do not face each other. In another example, the tape member 120 may be formed in a cross section where the second portion 122 and the second surface 111B face each other. In this case, the second portion 122 may be bonded to the second surface 111B at the first section $S_1$ and the second section $S_2$.

Further, in the above example, the first portion 121 is located near the opening 101 with respect to the width direction of the tape member 120 while the second portion 122 is located near the storing space SP, but the first portion 121 and the second portion 122 may be located in an opposite manner. It should be noted that with the top seal being formed in the bag 100, the opening 101 may be provided with the bag 100 afterward by cutting the portion between the top seal and the tape member 120 as described above. Accordingly, the tape member 120 may be located such that, in relation to the tape member 120, the opening 101 of the bag 100 is located opposite the storing space SP or the portion where the opening 101 of the bag is to be formed is located opposite the storing space SP.

Further, in the above example, the second section $S_2$ is not lo around the center of the longitudinal direction of the tape member 120 while the first section $S_1$ is defined at the rest thereof. However, any arrangement of each of the first section $S_1$ and the second section $S_2$ in the longitudinal direction is applicable. For instance, the second section $S_2$ may be located at either one or both of ends in the longitudinal direction of the tape member 120. Alternatively, a plurality of second sections $S_2$ may be located at the ends or a middle portion of the tape member 120.

Further, in the above example, regarding the manufacturing method of the bag 100, description is made on the example where a seal bar for forming the bonding region 140A is used on a front surface side while a seal bar for forming the bonding region 140B is used on a rear surface side, but the formation of the bonding regions 140A and 140B using the seal bars is not necessarily performed simultaneously. For instance, a semifinished product of the bag 100 where the bonding region 140B formed in advance may be distributed and after filling of the contents C, the storing space SP may be sealed by forming the bonding region 140A. Such a process is employed in a case where, for instance, the bag 100 is a stand-up pouch.

In the above case, after a first process (a formation process of the bonding region 140B) where the first portion 121 of the tape member 120 is bonded to the second surface 111B of the film 110 at the first section $S_1$ and the second section $S_2$, a process for filling the contents C into the storing space SP is performed, and then a second process (a formation process of the bonding region 140A) where the first portion 121 of the tape member 120 is bonded to the first surface 111A of the film 110 at the first section $S_1$ while the second portion 122 of the tape member 120 is bonded to the first surface 111A at the second section $S_2$ is further performed. It should be noted that the first process and second process may be exchanged in order. In either case, the process for filling the contents C into the storing space SP is performed between the first process and the second process.

Second Exemplary Embodiment

Figure 5:
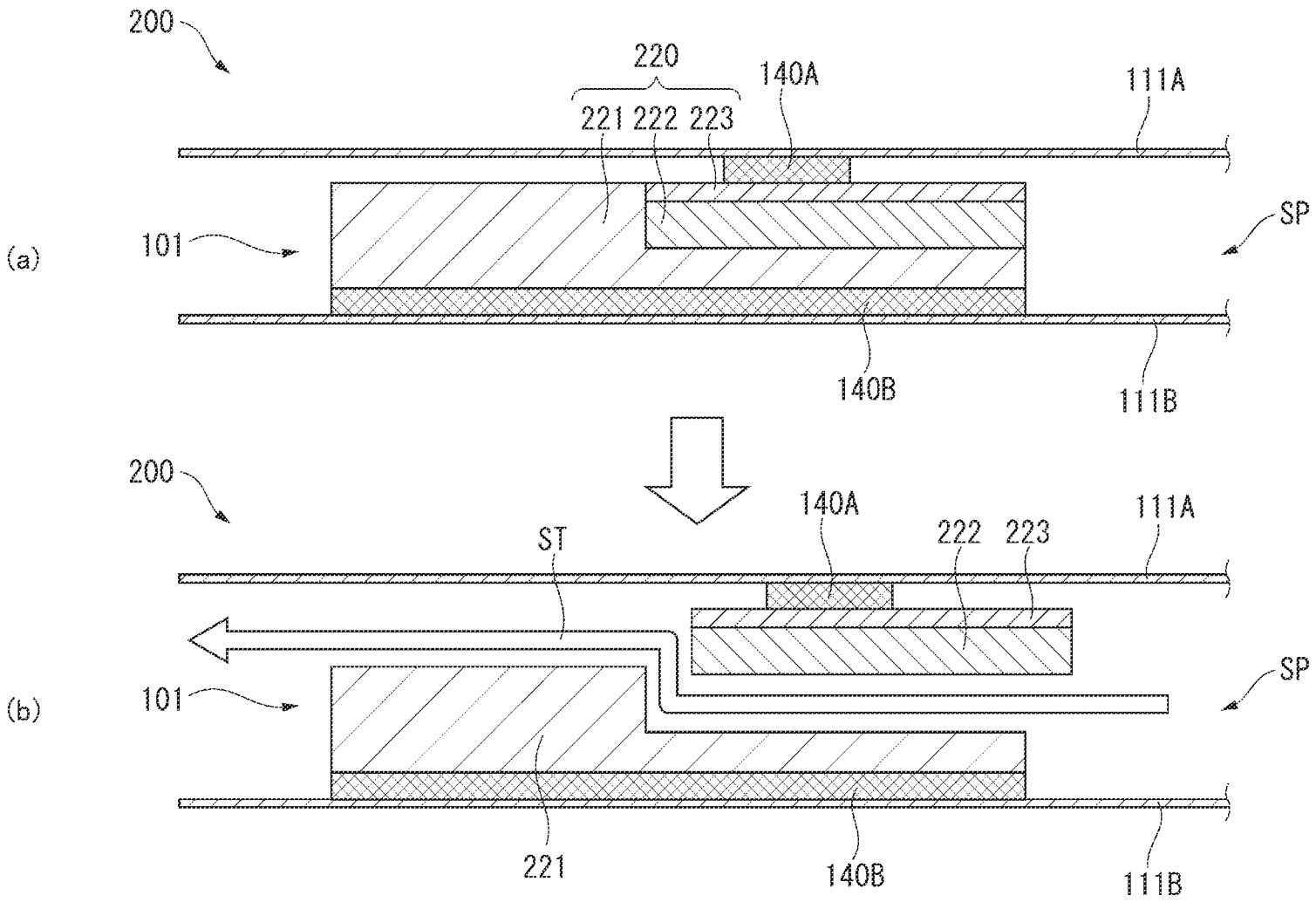
FIG. 5 is a cross-sectional view of a bag according to a second exemplary embodiment of the invention.

FIG. 5 is a cross-sectional view of a bag according to a second exemplary embodiment of the invention. As shown in FIG. 5, as compared with the above first exemplary embodiment, a bag 200 according to this exemplary embodiment is different in resin compositions forming a first portion 221 and a second portion 222 of a tape member 220 and, consequently, in the behavior of the tape member 220 during the heating of the contents. However, in terms of the rest including the configuration of the film 110, the second exemplary embodiment is similar to the first exemplary embodiment and thus the redundant description thereof is omitted.

In this exemplary embodiment, the tape member 220 is likewise formed by, for instance, extrusion molding of a polyolefin resin. More specifically, the tape member 220 may be formed of low density polyethylene (LDPE), linear low density polyethylene (LLDPE), or polypropylene (PP). PP may be homopolypropylene (HPP), random polypropylene (RPP), or block polypropylene (BPP). A known additive such as a stabilizer, an antioxidant, a lubricant, an antistatic, or a colorant may be added as required to the material of the tape member 220.

As in the example described with reference to FIG. 1 in the above first exemplary embodiment, the tape member 220 is divided into the first section $S_1$ and the second section $S_2$ in the longitudinal direction. Since a cross section at the first section $S_1$ is similar to that in the first exemplary embodiment, the illustration thereof is omitted. FIG. 5(*a*) shows a cross section at the second section $S_2$. A cross section of the tape member 220, which is the same at the first section $S_1$ and the second section $S_2$, includes the first portion 221 and the second portion 222. The first portion 221 is formed of the first resin composition, while the second portion 222 is formed of the second resin composition. The second resin composition is a resin composition different from the first resin composition. In this exemplary embodiment, for instance, a configuration described below as an example makes a bonding strength between the first portion 221 and the second portion 222 of the tape member 220 lower than a bonding strength between the first portion 221 and each of the first surface 111A and the second surface 111B and a bonding strength between the second portion 222 and the first surface 111A.

In this exemplary embodiment, a third portion 223 may be formed, as required, of a third resin composition between the first surface 111A and the second portion 222 as in the following example. With the third portion 223, which functions as a bonding layer, formed, the bonding strength between the second portion 222 and the first surface 111A is further increased, thus making the bonding strength between the first portion 221 and the second portion 222 relatively lower than the bonding strength between the second portion 222 and the first surface 111A. It should be noted that the third portion 223 is not necessarily formed and the bonding strength between the second portion 222 and the first surface 111A may be increased by bonding the first surface 111A and the second portion 222 via an adhesive. In this case, the adhesive is not limited to a particular one.

Specifically, resin compositions listed in Table 2 below are usable as the first resin composition, the second resin composition, and the third resin composition according to the second exemplary embodiment. It should be noted that HDPE in the table stands for high density polyethylene and PE stands for polyethylene. Although all of the combination examples shown in Table 2 can achieve an effect of this exemplary embodiment, it is preferable that the first resin composition is HPP and the second resin composition is LDPE. Further, in this case, it is more preferable that the third resin composition is HPP or RPP, further preferably, HPP. In the examples shown in Table 2, compatibility between the first resin composition and the second resin composition is relatively the worst among those between the resin composition forming the first surface 111A and the third resin composition, between the third resin composition and the second resin composition, between the second resin composition and the first resin composition, and between the first resin composition and the resin composition forming the second surface 111B.

TABLE 2

Combination Examples of Resin Compositions

| First Resin Composition | Second Resin Composition | Third Resin Composition |
|---|---|---|
| | | HPP |
| HPP | | BPP |
| | LDPE | |
| BPP | | RPP |
| | HDPE | |
| RPP | | LLDPE |
| | | Mixture of PP/PE |

As shown in FIG. 5(*a*), at the second section $S_2$, the first portion 221 of the tape member 220 is not bonded to the first surface 111A of the film 110 but bonded to only the second surface 111B. Specifically, at the second section $S_2$, the bonding region 140B is formed between the first portion 221 and the second surface 111B, while no bonding region is formed between the first portion 221 and the first surface 111A. Meanwhile, at the second section $S_2$, the second portion 222 of the tape member 220 is bonded to only the first surface 111A of the film 110 and not bonded to the second surface 111B. Specifically, at the second section $S_2$, the bonding region 140A is formed between the second portion 222 and the first surface 111A, while no bonding region is formed between the second portion 222 and the second surface 111B.

FIG. 5(*b*) shows a behavior of the tape member 220 at the second section $S_2$ during the heating of the contents. As described in the first exemplary embodiment, when the contents are heated in the bag 200, steam generated from the contents increases the inner pressure of the storing space SP. In this case, at the second section $S_2$, a portion with the lowest bonding strength between the first surface 111A and the second surface 111B of the film 110, i.e., the first portion 221 and the second portion 222 of the tape member 220, is peeled from each other as shown in FIG. 5(*b*). Thus, at the second section $S_2$, the storing space SP is brought into communication with the outer space through the gap between the first portion 221 and the second portion 222 of the tape member 220 during the heating of the contents, thereby enabling the discharge of the steam ST.

It should be noted that in this exemplary embodiment, the first portion 221 of the tape member 220 is bonded to both the first surface 111A and the second surface 111B of the film 110 at the first section $S_1$ with the storing space SP not in communication with the outer space as in the example described in the first exemplary embodiment with reference to FIG. 2(*b*). The second portion 222 may be bonded to the first surface 111A at the first section $S_1$ but, in this case, the first portion 221 and the second portion 222 are likely to be peeled from each other also at the first section $S_1$. However, since the bonding regions 140A and 140B between the first portion 221 and the first surface 111A and the second surface 111B are not peeled, the storing space SP is still not in communication with the outer space at the first section $S_1$.

As described above, in this exemplary embodiment, as in the first exemplary embodiment, the first portion 221 and the second portion 222 of the tape member 220 are formed respectively of the first resin composition and the second resin composition. A portion of the tape member 220 bonded to the first surface 111A and the second surface 111B of the film 110 are different between the first section $S_1$ and the second section $S_2$. Therefore, it is enabled to stably discharge steam through the second section $S_2$ when the inner pressure of the storing space SP increases due to the generation of the steam.

Third Exemplary Embodiment

Figure 6:
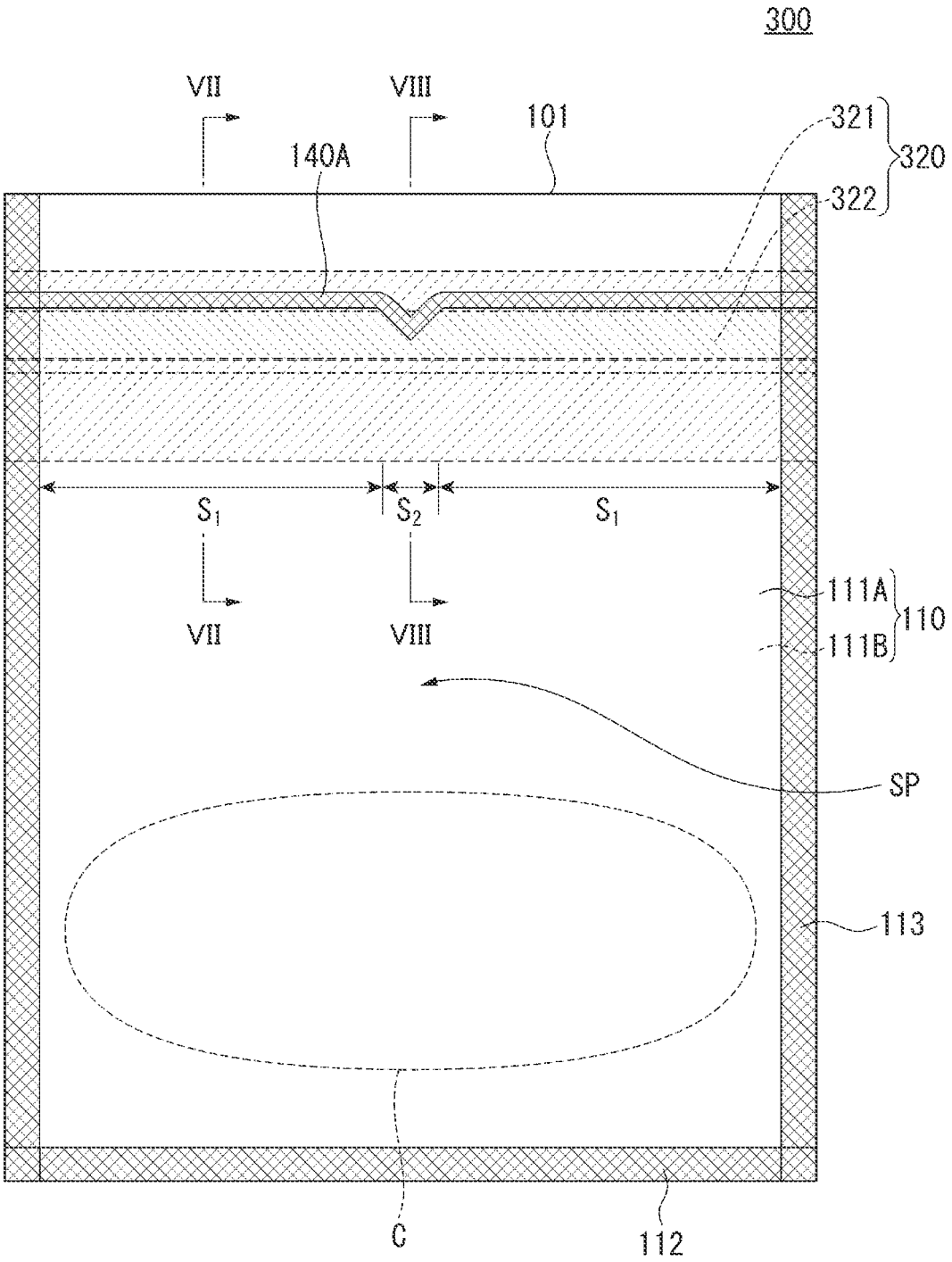
FIG. 6 is a plan view of a bag according to a third exemplary embodiment of the invention.
Figure 7:
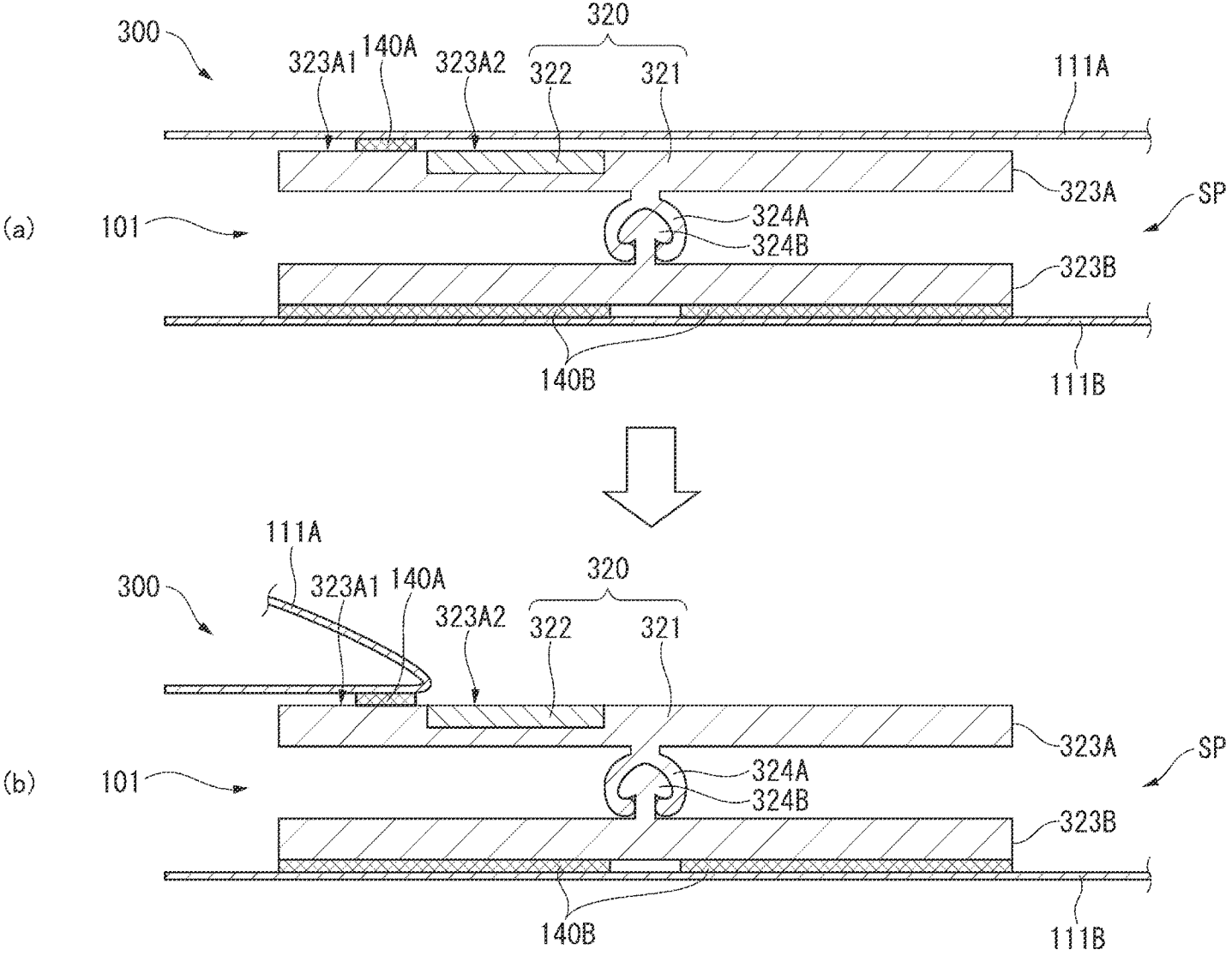
FIG. 7 is a cross-sectional view taken along a VII-VII line of the bag shown in FIG. 6.
Figure 8:
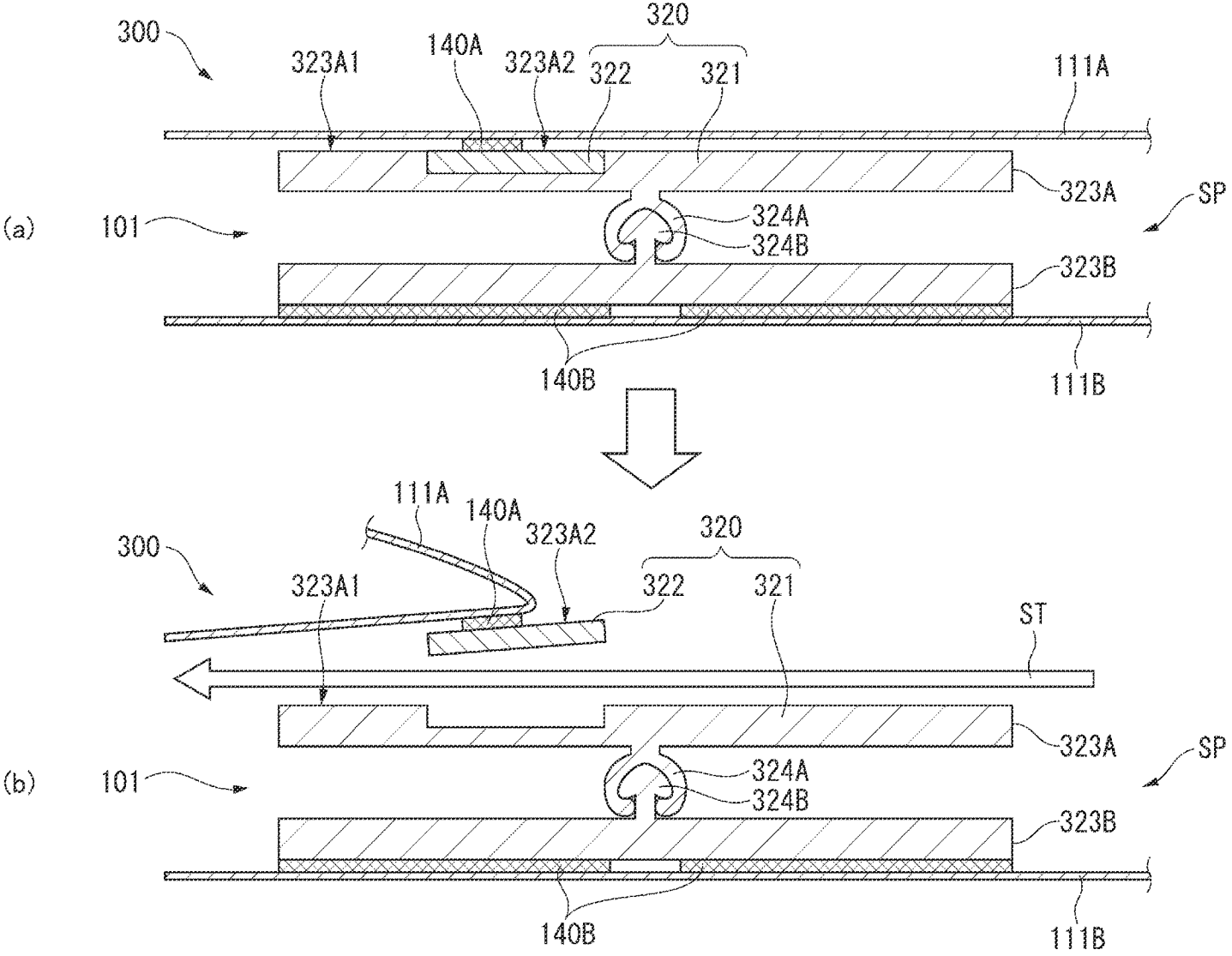
FIG. 8 is a cross-sectional view taken along a VIII-VIII line of the bag shown in FIG. 6.

FIG. 6 is a plan view of a bag according to a third exemplary embodiment of the invention. FIG. 7 and FIG. 8 are cross-sectional views of the bag taken along a VII-VII line and a VIII-VIII line shown in FIG. 6, respectively. Description will be made below on a configuration of the bag according to this exemplary embodiment with reference to these figures.

As shown in the figures, a bag 300 includes: the film 110; and a zipper tape 320 located between the first surface 111A and the second surface 111B of the film 110. The zipper tape 320 is bonded to the first surface 111A and the second surface 111B at least at a part relative to a width direction over the entire length thereof, thus defining one side of the storing space SP formed between the first surface 111A and the second surface 111B of the film 110. As described later, the zipper tape 320 includes, in a cross section, a first portion 321 formed of a first resin composition and a second portion 322 formed of a second resin composition. It should be noted that the configuration of the film 110 is similar to that in the above first exemplary embodiment and thus the redundant description thereof is omitted.

The zipper tape 320 is formed by, for instance, extrusion molding of a polyolefin resin. More specifically, the zipper tape 320 may be formed of low density polyethylene (LDPE), linear low density polyethylene (LLDPE), or polypropylene (PP). PP may be homopolypropylene (HPP), random polypropylene (RPP), or block polypropylene (BPP). A known additive such as a stabilizer, an antioxidant, a lubricant, an antistatic, or a colorant may be added as required to the material of the zipper tape 320.

As shown in FIG. 6, the zipper tape 320 is divided into the first section $S_1$ and the second section $S_2$ with respect to the longitudinal direction. FIG. 7(*a*) shows a cross section at the first section $S_1$ and FIG. 8(*a*) shows a cross section at the second section $S_2$. In this exemplary embodiment, the zipper tape 320 has the same cross section at the first section $S_1$ and the second section $S_2$. Specifically, the zipper tape 320 includes a female base strip 323A bonded to the first surface 111A, a male base strip 323B bonded to the second surface 111B, and a female engagement portion 324A and a male engagement portion 324B that project respectively from mutually facing surfaces of the female base strip 323A and the male base strip 323B and are engageable with each other. Regarding a relationship between the first portion 321 and the second portion 322 of the zipper tape 320 described above, the second portion 322 forms a part (shown as a surface 323A2) of a surface of the female base strip 323A facing the first surface 111A. Meanwhile, the first portion 321 forms the whole of the male base strip 323B, the female engagement portion 324A, and the male engagement portion 324B and the rest of the female base strip 323A including a surface (shown as a surface 323A1) facing the first surface 111A.

As described above, the first portion 321 of the zipper tape 320 is formed of the first resin composition, while the second portion 322 is formed of the second resin composition. The second resin composition is a resin composition different from the first resin composition. In this exemplary embodiment, for instance, the configuration described as an example in the above second exemplary embodiment is employed to cause a bonding strength between the first portion 321 and the second portion 322 of the zipper tape 320 to be lower than the bonding strength between the first portion 321 and each of the first surface 111A and the second surface 111B and the bonding strength between the second portion 322 and the first surface 111A. Specifically, for instance, a third portion (not shown) is formed of a third resin composition between the first surface 111A and the second portion 322 or an adhesive is interposed between the first surface 111A and the second portion 322, thereby increasing the bonding strength between the second portion 322 and the first surface 111A to cause the bonding strength between the first portion 321 and the second portion 322 to be relatively lower than the bonding strength between the second portion 322 and the first surface 111A. Alternatively, the combination of resin compositions described as an example in the above first exemplary embodiment may be employed, thereby making the bonding strength between the first portion 321 and the second portion 322 of the zipper tape 320 lower than the bonding strength between the first portion 321 and each of the first surface 111A and the second surface 111B and the bonding strength between the second portion 322 and the first surface 111A.

Further, in this exemplary embodiment, by virtue of the configuration regarding the first portion 321, the second portion 322, and the first surface 111A as described above and the selection of the material and the shape of each of the female engagement portion 324A and the male engagement portion 324B, the bonding strength between the first portion 321 and the second portion 322 of the zipper tape 320 is lower than an engagement strength between the female engagement portion 324A and the male engagement portion 324B during the later-described heating of the contents.

It should be noted that the shape of each of the female engagement portion 324A and the male engagement portion 324B is not limited to the shape as in the example shown but may be in a shape of any of engagement portions of known various zipper tapes where a claw-shape, a hook-shape, a nodule-shape, or the like is combined. Further, although a pair of female engagement portion 324A and male engagement portion 324B are located in the example shown, a plurality of pairs of female engagement portions 324A and male engagement portions 324B may be located. The female engagement portion 324A and the male engagement portion 324B enable the bag 300 to be sealed, unsealed, and resealed.

As shown in FIG. 7(*a*), at the first section $S_1$, the first portion 321 of the zipper tape 320 is bonded to both the first surface 111A and the second surface 111B of the film 110. Specifically, at the first section $S_1$, the bonding region 140A is formed between the first portion 321 of the zipper tape 320, i.e., the surface 323A1 of the female base strip 323A formed of the first resin composition, and the first surface 111A, while the bonding region 140B is formed between the male base strip 323B, which is also included in the first portion 321, and the second surface 111B. It should be noted that it is optional whether or not the second portion 322 is bonded to the first surface 111A at the first section $S_1$, since the first section $S_1$ is a section where steam ventilation is not enabled even during the heating of the contents as described later.

Meanwhile, as shown in FIG. 8(*a*), at the second section $S_2$, the first portion 321 of the zipper tape 320 is not bonded to the first surface 111A of the film 110 but bonded only to the second surface 111B. Specifically, at the second section $S_2$, the bonding region 140B is formed between the first portion 321, i.e., the male base strip 323B, and the second surface 111B, while no bonding region is formed between the surface 323A1, which is formed of the first resin composition, of the female base strip 323A and the first surface 111A. Meanwhile, at the second section $S_2$, the second portion 322 of the zipper tape 320 is bonded to the first surface 111A of the film 110. Specifically, at the second section $S_2$, the bonding region 140A is formed between the second portion 322, i.e., the surface 323A2 of the female base strip 323A formed of the second resin composition, and the first surface 111A.

FIG. 7(*b*) and FIG. 8(*b*) show behaviors of the zipper tape 320 at the first section $S_1$ and the second section $S_2$ during the heating of the contents, respectively. As described in the first exemplary embodiment, when the contents are heated in the bag 300, steam generated from the contents increases the inner pressure of the storing space SP. In this case, at the second section $S_2$, a portion with the lowest bonding strength between the first surface 111A and the second surface 111B of the film 110, i.e., the first portion 321 and the second portion 322 of the zipper tape 320, is peeled from each other as shown in FIG. 8(*b*). At this time, in the female base strip 323A, the second portion 322, that is, a portion including the surface 323A2 formed of the second resin composition, is peeled from the rest thereof including the surface 323A1 formed of the first resin composition. At the second section $S_2$, since the female base strip 323A is bonded to the first surface 111A of the film 110 only at the surface 323A2 as described above, the peeling described above causes the rest of the female base strip 323A to be separated from the first surface 111A. Thus, at the second section $S_2$, the storing space SP is brought into communication with the outer space through the gap between the first portion 321 and the second portion 322 of the zipper tape 320 during the heating of the contents, thereby enabling the discharge of the steam ST.

Meanwhile, at the first section $S_1$, the first portion 321 of the zipper tape 320 is bonded to both the first surface 111A and the second surface 111B of the film 110 via the bonding regions 140A and 140B as shown in FIG. 7(*b*). In this regard, since the bonding strength between the first portion 321 and each of the first surface 111A and the second surface 111B is higher than the bonding strength between the first portion 321 and the second portion 322 and the engagement strength between the female engagement portion 324A and the male engagement portion 324B during the heating of the contents is higher than the bonding strength between the first portion 321 and the second portion 322, the peeling is not caused at the first section $S_1$ even when the first portion 321 and the second portion 322 are peeled from each other at the second section $S_2$. With the steam ST discharged at the second section $S_2$, an increase in the inner pressure of the storing space SP is prevented. Consequently, the first portion 321 and the second portion 322 are not peeled at the first section $S_1$ unlike at the second section $S_2$, so that the storing space SP is not brought into communication with the outer space at the first section $S_1$.

In this regard, in the example shown, the male base strip 323B of the zipper tape 320 is bonded to the second surface 111B of the film 110 via the bonding region 140B on both a side near the opening 101 and a side near the storing space SP, while the female base strip 323A is bonded to the first surface 111A of the film 110 via the bonding region 140A only on the side near the opening 101 and not bonded to the first surface 111A on the side near the storing space SP. Thus, in a case where the inner pressure of the storing space SP increases, the first surface 111A is folded on the side near the opening 101 with respect the zipper tape 320 as shown in FIG. 7(*b*) and FIG. 8(*b*), thereby causing a force resulting from the inner pressure to be applied as a force causing the female base strip 323A and the male base strip 323B to be sheared in the width direction. Therefore, for instance, as compared with in a case where a force to pull the female base strip 323A and the male base strip 323B in a thickness direction is applied, the engagement strength between the female engagement portion 324A and the male engagement portion 324B is improved, enabling the engagement between the female engagement portion 324A and the male engagement portion 324B to be maintained against a larger inner pressure.

As described above, in this exemplary embodiment, as in the first exemplary embodiment and the second exemplary embodiment, the first portion 321 and the second portion 322 of the zipper tape 320 are formed respectively of the first resin composition and the second resin composition. The portion of the zipper tape 320 bonded to the first surface 111A and the second surface 111B of the film 110 are different between the first section $S_1$ and the second section $S_2$ as described above. Thus, it is enabled to stably discharge steam through the second section $S_2$ when the inner pressure of the storing space SP increases due to the generation of the steam. In addition, in this exemplary embodiment, the zipper tape 320 allows the bag 300 to be resealed, thus enabling a user to fill the contents into the storing space SP with the zipper tape 320 unsealed and to heat the contents with the zipper tape 320 resealed afterward.

Although the preferred exemplary embodiments of the invention are described above in detail with reference to the attached drawings, the invention is not limited to these examples. Clearly, a variety of modifications and alterations may occur to those skilled in the art to which the invention pertains within the scope of the technical idea according to the claims and, of course, it should be understood that these also belong to the technical scope of the invention.

The invention claimed is:

1. A bag comprising:

a bag body at least having a first surface and a second surface facing each other with a storing space formed between the first surface and the second surface; and a tape member provided between the first surface and the second surface and defining one side of the storing space, a cross section of the tape member comprising a first portion formed of a first resin composition and a second portion formed of a second resin composition different from the first resin composition, wherein the first portion is bonded to both the first surface and the second surface at a first section of a longitudinal direction of the tape member while bonded only to the second surface at a second section of the longitudinal direction, the second portion is bonded to the first surface at the second section, and a melting point of the first resin composition is higher than a melting point of the second resin composition by 10 degrees C. or more, and wherein the first resin composition comprises homopolypropylene when the second resin composition comprises a mixture of low-density polyethylene and polypropylene or a mixture of linear low-density polyethylene and polypropylene, or wherein the first resin composition comprises random polypropylene when the second resin composition comprises m-linear low-density polyethylene.

2. The bag according to claim 1, wherein a bonding strength between the second portion and the first surface is lower than a bonding strength between the first portion and the first surface.

3. The bag according to claim 2, wherein in terms of a relationship with a resin composition forming a sealant layer of the first surface, the first resin composition has a higher compatibility than the second resin composition.

4. The bag according to claim 1, wherein the tape member is a zipper tape comprising: first and second base strips bonded respectively to the first surface and the second surface; and respective engagement portions that project from mutually facing surfaces of the first and second base strips and are engageable with each other, the second portion forms a part of a surface of the first base strip facing the first surface, and the first portion forms the engagement portion, the second base strip, and the rest of the first base strip.

5. The bag according to claim 1, wherein the tape member is provided such that an opening of the bag is located opposite the storing space in relation to the tape member.

6. The bag according to claim 1, wherein the tape member is provided such that a portion where an opening of the bag is to be formed is located opposite the storing space in relation to the tape member.

7. The bag according to claim 1, wherein the bag body is in a form of a stand-up pouch.

8. The bag according to claim 1, wherein an opposite side of the storing space from the tape member is not sealed.

9. A manufacturing method of the bag according to claim 1, the method comprising:

a first step of bonding the first portion to the second surface at the first section and the second section; and a second step of bonding the first portion to the first surface at the first section while bonding the second portion to the first surface at the second section.

10. The manufacturing method of the bag according to claim 9, further comprising a step of filling contents into the storing space, the step being performed between the first step and the second step.

11. A bag comprising:

a bag body at least having a first surface and a second surface facing each other with a storing space formed between the first surface and the second surface; and a tape member provided between the first surface and the second surface and defining one side of the storing space, a cross section of the tape member comprising a first portion formed of a first resin composition and a second portion formed of a second resin composition different from the first resin composition, wherein the first portion is bonded to both the first surface and the second surface at a first section of a longitudinal direction of the tape member while bonded only to the second surface at a second section of the longitudinal direction, the second portion is bonded to the first surface at the second section, and wherein a bonding strength between the first portion and the second portion is lower than a bonding strength between the first portion and each of the first surface and the second surface.

12. The bag according to claim 11, wherein in terms of a relationship with a resin composition forming a sealant layer of each of the first surface and the second surface, a compatibility between each of the first resin composition and the second resin composition and the sealant layer is higher than a compatibility between the first resin composition and the second resin composition.

13. The bag according to claim 11, wherein the cross section of the tape member further comprises a third portion provided between the second portion and the first surface and formed of a third resin composition.

14. The bag according to claim 11, wherein the second portion and the first surface are bonded to each other with an adhesive.

15. The bag according to claim 11, wherein the tape member is a zipper tape comprising: first and second base strips bonded respectively to the first surface and the second surface; and respective engagement portions that project from mutually facing surfaces of the first and second base strips and are engageable with each other, the second portion forms a part of a surface of the first base strip facing the first surface, and the first portion forms the engagement portion, the second base strip, and the rest of the first base strip.

16. The bag according to claim 11, wherein the tape member is provided such that an opening of the bag is located opposite the storing space in relation to the tape member.

17. The bag according to claim 11, wherein the tape member is provided such that a portion where an opening of the bag is to be formed is located opposite the storing space in relation to the tape member.

18. The bag according to claim 11, wherein the bag body is in a form of a stand-up pouch.

19. The bag according to claim 11, wherein an opposite side of the storing space from the tape member is not sealed.

20. A manufacturing method of the bag according to claim 11, the method comprising:

a first step of bonding the first portion to the second surface at the first section and the second section; and a second step of bonding the first portion to the first surface at the first section while bonding the second portion to the first surface at the second section.

21. The manufacturing method of the bag according to claim 20, further comprising a step of filling contents into the storing space, the step being performed between the first step and the second step.

* * * * *